US005144600A

United States Patent [19]

Cheng

[11] Patent Number: 5,144,600

[45] Date of Patent: Sep. 1, 1992

[54] ARRANGEMENT FOR AND METHOD OF WAKING A SLEEPER

[76] Inventor: Peter S. C. Cheng, 5 Ross Street, Toronto, Ontario, Canada, M5T 1Z8

[21] Appl. No.: 726,373

[22] Filed: Jul. 5, 1992

[51] Int. Cl.[5] ..... G04B 47/033

[52] U.S. Cl. ..... 368/12; 368/10

[58] Field of Search ..... 368/12, 10, 243-269

[56] References Cited

U.S. PATENT DOCUMENTS

| | | | |
|---|---|---|---|
| 952,710 | 3/1910 | Pesche | 368/12 |
| 2,460,133 | 1/1949 | Pedis | 368/12 |
| 2,580,598 | 1/1952 | Rody | 368/12 |
| 5,072,429 | 10/1991 | Mair | 368/12 |

FOREIGN PATENT DOCUMENTS

| | | | |
|---|---|---|---|
| 2405771 | 8/1975 | Fed. Rep. of Germany | 368/12 |

*Primary Examiner*—Bernard Roskoski

*Attorney, Agent, or Firm*—Kirschstein, Ottinger, Israel & Schiffmiller

[57] ABSTRACT

An underpillow vibrating assembly resists relative displacement between itself and a pillow, and reliably transmits vibrations through the pillow to wake a sleeper. The assembly includes a housing containing a vibrator as well as a planar vibratory plate connected to, and extending past opposite ends outwardly of, the housing.

16 Claims, 2 Drawing Sheets

FIG. 3
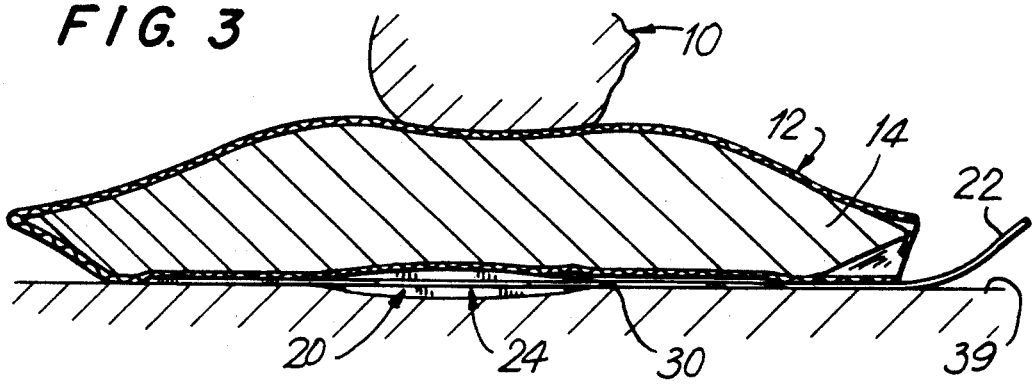
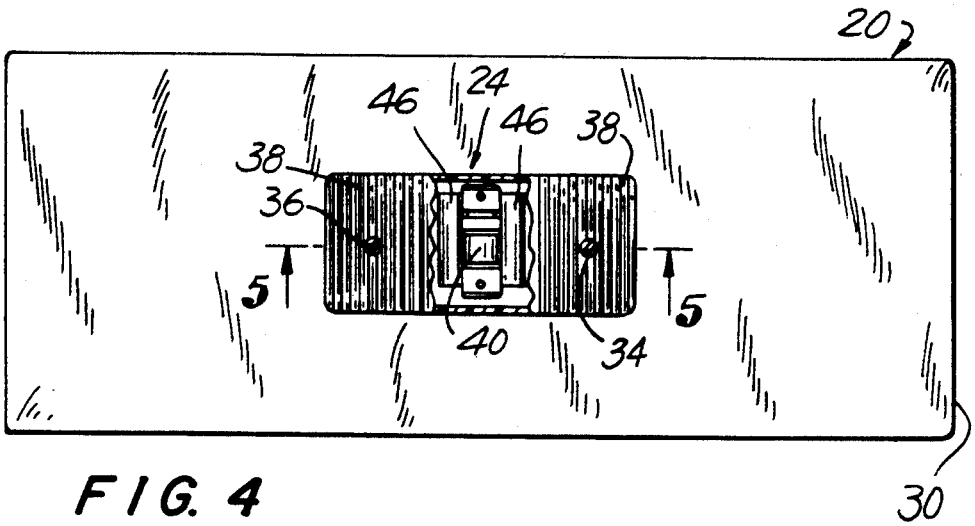
FIG. 4
FIG. 5
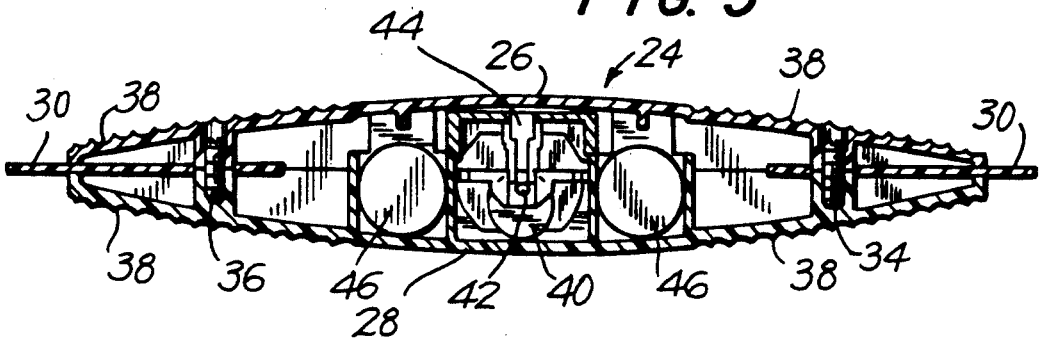

ARRANGEMENT FOR AND METHOD OF WAKING A SLEEPER

BACKGROUND OF THE INVENTION

1. Field of the Invention

This invention generally relates to an arrangement for, and a method of, waking a sleeper by generating vibrations in an underpillow housing and, more particularly, to resisting relative displacement between the housing and the pillow, as well as transmitting intermittent vibrations through the pillow to reliably wake the sleeper at a set time.

2. Description of Related Art

Underpillow vibrators to wake a sleeper at a set time are generally known. See, for example, U.S. Pat. Nos. 952,710; 2,460,133; 4,028,882 and 4,093,944. See, also, U.S. Pat. Nos. 2,561,481; 2,580,598; 2,923,122 and 3,786,628.

Although generally satisfactory for their intended purpose, experience has shown that the known vibrators are often displaced from their original positions underneath their respective pillows due to repeated tossing and turning by the sleeper during sleep. The pillows are typically pounded, displaced up and down and side to side, and turned around and upside-down during sleep. One of the sleeper's arms, or perhaps another sleeper's arm, might be inserted underneath the pillow during sleep. Also, the vibrator itself tends to wriggle out from the center to the periphery of the pillow during sleep.

The net result of all these actions is that the underpillow vibrator may be dislodged from its original to a remote position In such event, when the remotely positioned vibrator is actuated at the set time, the vibrations may not be reliably transmitted through the pillow to the head of the sleeper to wake the sleeper. The vibrations may be so low, due to the remote position of the vibrator, that any such soft vibrations may actually lull the sleeper to remain asleep at the set time. Hence, the sleeper must remember to re-position the vibrator before retiring.

SUMMARY OF THE INVENTION

1. Objects of the Invention

It is a general object of this invention to reliably waken a sleeper.

It is another object of this invention to resist relative displacement between an underpillow vibrator and a pillow during sleep, despite the actions of a restless sleeper.

Another object of this invention is to maintain an underpillow vibrator close to the sleeper's head.

2. Features of the Invention

In keeping with these objects, and others which will become apparent hereinafter, one feature of this invention resides, briefly stated, in an arrangement for, and a method of, waking a sleeper whose head rests on a pillow, which comprises settable timer means such as an alarm clock for generating an electrical alarm signal at a time typically set by the sleeper before retiring to sleep, as well as vibration means electrically connected to the timer means for generating vibrations at said set time.

A housing contains the vibration means. A vibratory plate is mounted to the housing for vibrating movement during operation of the vibration means. In a preferred embodiment, the vibratory plate is connected to the housing and extends outwardly of opposite end regions of the housing. The plate, as well as the housing, lies underneath the pillow over a predetermined surface area.

In accordance with this invention, the surface area of the plate is so large that relative displacement between the housing and the pillow is resisted. The housing and the plate mounted thereto may be inserted within a pillowcase for the pillow, or may be positioned underneath the pillowcase. In either event, the relatively broad surface area provided by the vibratory plate insures that the restless sleeper will have his or her head overlying at least a portion of the plate. The outer surface of the housing may also be roughened to frictionally engage the pillow/pillowcase and a bedsheet underlying the same to further prevent such relative displacement.

The vibrations generated by the vibration means not only vibrates the housing, but also vibrates the plate mounted thereto, thereby presenting a large vibrating area through which the vibrations are transmitted through the pillow. This large vibrating area, in a preferred embodiment, occupies at least one-third of the total area of the pillow. Even the most restless sleeper's head will lie over at least some area of the plate and/or housing and, hence, the sleeper will be reliably wakened at the set time.

In the preferred embodiment, the vibration means is an on-board DC motor having an off-center rotor. The motor is controlled by a control circuit operative for intermittently generating a series of vibrations spaced apart in time by still intervals in which no vibrations are generated. For example, one-second still intervals between three-second vibrations have been found to be effective.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is a view analogous to FIG. 2 in another preferred method of use;

FIG. 4 is a broken-away, top plan view of an underpillow assembly used with the arrangement of FIG. 1;

FIG. 5 is an enlarged, sectional view taken on line 5—5 of FIG. 4.

DETAILED DESCRIPTION OF THE PREFERRED EMBODIMENTS

Figure 1:
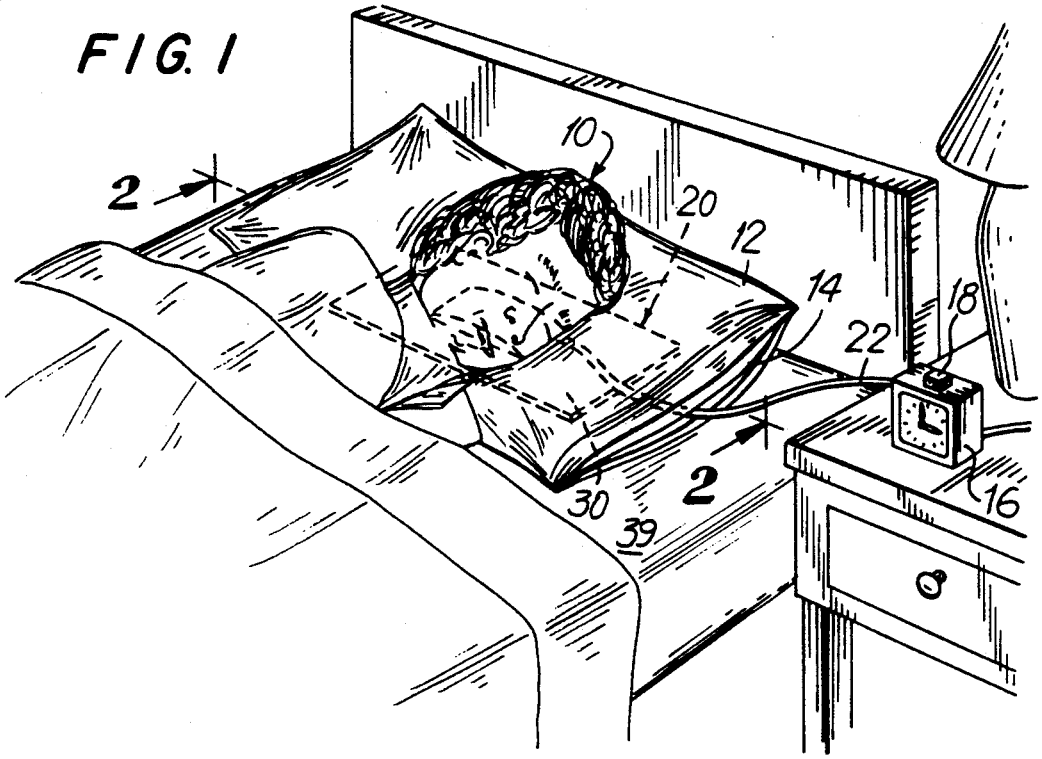
FIG. 1 is a perspective view of an arrangement according to the method of this invention in use.

Referring now to the drawings, FIG. 1 shows a sleeper whose head 10 rests on a pillowcase 12 that surrounds a pillow 14 of conventional construction. A settable alarm clock 16 of conventional construction generates an electrical alarm signal at a time set by the sleeper, typically before retiring to bed. The alarm clock 16 is conveniently mounted on a nearby nightstand. An alarm shut-off switch 18 is mounted at the top of the alarm clock 16 within ready access of the sleeper upon awakening.

Figure 2:
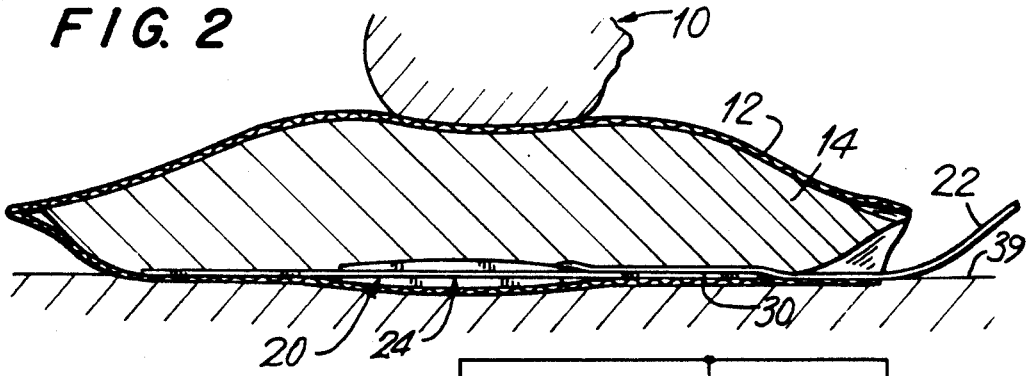
FIG. 2 is an enlarged, sectional view taken on line 2—2 of FIG. 1 in one preferred method of use.

As best seen in FIG. 4, an underpillow assembly 20 is electrically connected to the clock 16 by means of an electrical cable 22. The assembly 20 includes an elongated housing 24 having an upper housing part 26 and a lower housing part 28 (see FIG. 5), as well as a generally rectangular vibratory plate 30 mounted to, and extending in a plane outwardly of, opposite end regions of the housing. The plate 30 is held securely between the housing parts 26, 28 by clamping screws 34, 36. The housing parts have roughened outer surfaces advantageously provided by ribs 38 extending transversely across the width of the housing. The ribs 38 frictionally engage, as shown in FIG. 2, the bottom of the pillow 14 as well as an inner bottom surface of the pillowcase 12. The ribs 38 frictionally engage, as best shown in FIG. 3, the outer bottom surface of the pillowcase 12 as well as the upper surface of a bedsheet 39. The housing and the plate are constituted of a synthetic rigid or semi-rigid plastic material, and form an integral unit.

The assembly 20 further includes a vibrator advantageously constituted of a DC motor 40 having an off-center output rotor shaft 42 operative for repeatedly reciprocating a piston 44 up and down into sudden and rapid impact with the upper housing part 26, thereby vibrating the entire housing and the vibratory plate rigidly connected thereto. The motor 40 is powered by a pair of on-board batteries 46 together supplying 3v DC in the preferred embodiment.

Figure 6:
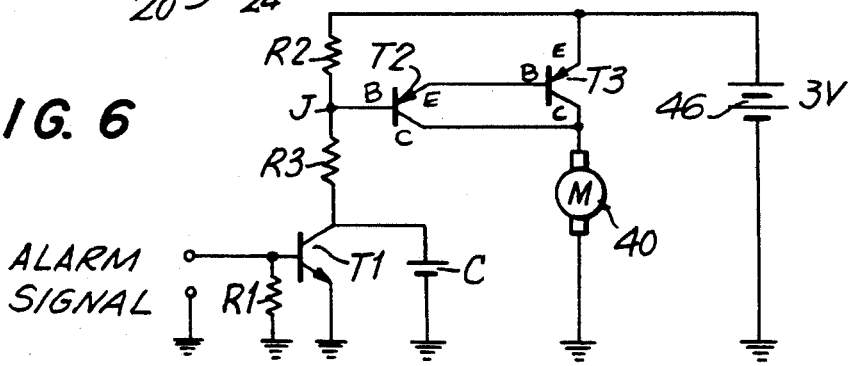
FIG. 6 is an electrical schematic of a control circuit for use with the arrangement of FIG. 1.

As best seen in FIG. 6, a control circuit is mounted on-board the housing and includes a first transistor T1 whose emitter is grounded and whose collector is grounded through a capacitor C, typically 2.2 $\mu$F. The base of the transistor T1 is grounded through a resistor R1. The alarm signal from the clock 16 is transmitted to the base of the transistor T1.

The collector of transistor T1 is connected to a voltage divider including resistors R2 and R3 interconnected at a junction J which is directly connected to the base of a second transistor T2. The emitter of transistor T2 is connected to the base of a third transistor T3. The collectors of transistors T2 and T3 are connected together and to one side of the motor 40. The emitter of transistor T3 is connected to resistor R2 and to the positive side of the battery 46.

Preferred values for the resistors R1, R2 and R3 are 1k$\Omega$, 33k$\Omega$ and 1M$\Omega$, respectively. Transistors T1 and T2 are Model Nos. 9014C and 9015C, respectively. Transistor T3 is Model No. 8550C.

The control circuit with the preferred values given above is operative for generating series of vibrations spaced apart in time by still intervals in which no vibrations are generated. In the preferred embodiment, each still interval measures about one second, and each series of vibrations measures about three seconds. The intermittently generated vibrations have been found effective in waking a sleeper, rather than lulling a sleeper to remain asleep.

In use, the sleeper, before retiring, sets the alarm clock 16 to a set wake-up time. The underpillow assembly 20 has either been inserted into the pillowcase 12 underneath the pillow 14 (FIG. 2), or has been positioned underneath the pillowcase 12 (see FIG. 3) on top of the bedsheet 39. At the set time, the motor 40 is actuated to generate intermittent vibrations. These vibrations vibrate the housing 24 and the plate 30. The plate occupies a rather large surface area underneath the pillow, typically at least one-third of the total surface area thereof. This relatively broad surface area is sufficient to transmit the intermittent vibrations through the pillow to the sleeper's head to wake the sleeper. Relative displacement between the assembly 20 and the pillow is resisted due not only to the relatively broad surface area of the assembly 20, but also to the presence of the ribs 38. Roughened surfaces may also be provided on opposite surfaces of the plate 30 for even better position retention.

Upon awakening, the sleeper need only depress the alarm shut-off switch 18 to prevent further vibrations from being generated.

In another variant of this invention, the alarm clock 16 need not be remotely positioned away from the assembly 20, but may be integrally incorporated therein. This variant would eliminate the need for the electrical cable 22.

Rather than a single vibratory plate, a pair of right- and left-side end plates could extend in a common plane exteriorly of opposite ends of the housing. The plate or plates need not be discrete elements, but could, instead, be integrally molded with the housing to simplify assembly and manufacture.

It will be understood that each of the elements described above, or two or more together, also may find a useful application in other types of constructions differing from the types described above.

While the invention has been illustrated and described as embodied in an arrangement for and method of waking a sleeper, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I CLAIM:

1. Arrangement for waking a sleeper whose head rests on a pillow, comprising:

(a) settable timer means for generating an electrical alarm signal at a set time;

(b) vibration means electrically connected to the timer means for generating vibrations at said set time;

(c) a housing for containing the vibration means; and (d) a vibratory plate connected to the housing for vibrating movement during operation of the vibration means, said plate extending outwardly of the housing underneath the pillow over a predetermined surface area sufficient to resist relative displacement between the housing and the pillow and to transmit the vibrations through the pillow to wake the sleeper.

2. The arrangement according to claim 1, wherein the timer means includes an alarm clock, and wherein the vibration means includes an actuatable, electrical motor and an electrical conductor between the motor and the clock, said conductor conducting the alarm signal to the motor to actuate the motor.

3. The arrangement according to claim 1, wherein the vibrator means includes an electrical motor having an off-center rotor.

4. The arrangement according to claim 1, wherein the vibration means includes an electrical motor and control means for intermittently causing the vibrations to be generated.

5. The arrangement according to claim 4, wherein the control means generates series of vibrations spaced apart in time by still intervals in which no vibrations are generated.

6. The arrangement according to claim 1, wherein the vibration means is electrically powered by batteries on-board the housing.

7. The arrangement according to claim 1, wherein the housing includes an upper and lower section between which the plate is held in position.

8. The arrangement according to claim 1, wherein the housing has opposite end regions, and wherein the vibratory plate connected to the housing extends outwardly in opposite directions from the opposite end regions of the housing.

9. The arrangement according to claim 1, wherein the housing has a roughened surface for frictionally engaging the pillow.

10. The arrangement according to claim 1; and further comprising a pillowcase enveloping the pillow, and wherein the plate is mounted within the pillowcase underneath the pillow.

11. The arrangement according to claim 1; and further comprising a pillowcase enveloping the pillow, and wherein the plate is mounted below the pillowcase.

12. The arrangement according to claim 8, wherein the plate has a generally rectangular configuration and is constituted of a semi-rigid material.

13. Method of waking a sleeper whose head rests on a pillow, comprising the steps of:

(a) generating an electrical alarm signal at a set time;

(b) generating vibrations at said set time in a housing;

(c) positioning the housing underneath the pillow; and (d) transmitting the vibrations through the pillow and resisting relative displacement between the housing and the pillow, by mounting to the housing for vibrating movement a vibratory plate that extends outwardly of the housing underneath the pillow.

14. The method according to claim 13, wherein the step of generating vibrations is performed intermittently.

15. The method according to claim 13, wherein the step of positioning the housing is performed by inserting the housing, with the plate mounted thereto, within a pillowcase surrounding the pillow.

16. The method according to claim 13, wherein the step of positioning the housing is performed by placing the housing, with the plate mounted thereto, underneath a pillowcase surrounding the pillow.

* * * * *